United States Patent [19]

Davis et al.

[11] 4,142,839

[45] Mar. 6, 1979

[54] CENTRIFUGAL PUMP FOR HIGH V/L PERFORMANCE

[75] Inventors: H. Dean Davis, Greenwich; Desh K. Kapur, Elyria, both of Ohio

[73] Assignee: Lear Siegler, Inc., Elyria, Ohio

[21] Appl. No.: 546,338

[22] Filed: Feb. 3, 1975

[51] Int. Cl.[2] ..... F04B 23/04

[52] U.S. Cl. ..... 417/89; 415/74; 415/143; 415/198.1; 415/215

[58] Field of Search ..... 417/79, 81, 80, 89, 417/76, 199 A, 85, 87; 415/74, 143, 215, 106, 109, 198, 52; 416/176, 177

[56] References Cited

U.S. PATENT DOCUMENTS

| | | | |
|---|---|---|---|
| 718,557 | 1/1903 | Wenzel | 415/143 X |
| 1,273,876 | 7/1918 | Kothny et al. | 417/72 |
| 2,368,530 | 1/1945 | Edwards | 417/199 A |
| 2,659,312 | 11/1953 | Wahle | 415/106 |
| 2,853,013 | 9/1958 | Lung | 417/81 X |
| 3,384,022 | 5/1968 | Oshima | 415/143 |
| 3,442,220 | 5/1969 | Mottram et al. | 415/215 |
| 3,522,997 | 8/1970 | Rylewski | 415/215 |
| 3,733,816 | 5/1973 | Nash et al. | 60/39.66 |

FOREIGN PATENT DOCUMENTS

| | | | |
|---|---|---|---|
| 968742 | 3/1958 | Fed. Rep. of Germany | 415/109 |
| 496820 | 12/1938 | United Kingdom | 416/183 |

*Primary Examiner*—William L. Freeh
*Assistant Examiner*—Edward Look
*Attorney, Agent, or Firm*—Maky, Renner, Otto & Boisselle

[57] ABSTRACT

The centrifugal pump comprises a unique combination of a centrifugal impeller, inducer and jet pump having the capability of handling incoming fluids with a minimum V/L ratio of 1.0. The motive flow for the jet nozzle is provided by high pressure fluid discharge from the centrifugal impeller, and the high velocity jet is used both to create the suction and entrainment of the fluid coming from the suction inlet and to break up the large incoming vapor bubbles.

14 Claims, 7 Drawing Figures

CENTRIFUGAL PUMP FOR HIGH V/L PERFORMANCE

BACKGROUND OF THE INVENTION

This invention relates generally as indicated to a centrifugal pump especially suited for use in pumping aircraft fuels and the like wherein the incoming fuel mixtures have a high ratio of fuel vapor and/or air and liquid fuel, termed V/L herein, and the fuel is delivered as a liquid fuel under pressure.

Aircraft fuels normally contain a certain amount of dissolved air which evolves when the pressure in the fuel tanks is lowered as may occur with increasing aircraft altitudes. The fuel is generally supplied to the engines of the aircraft by an engine driven, positive displacement pump, and in most cases the fuel tanks are far removed from and located well below the engine driven pump, whereby the fuel flow from the tank to the engine driven pump encounters additional pressure drop due to line resistance and change in height from the tank to the engine driven pump, producing relatively low pressure at the pump inlet. This low pressure at the pump inlet results in separation of the air dissolved in the fuel and partial evaporation of the fuel, creating a mixture of vapor and liquid. Also, the varying environment in which the aircraft operates may cause the fuel in the tanks to vary in temperature over a wide range from −65° F. to +135° F. or more, and higher fuel temperatures along with low fuel pressures result in additional fuel vaporization, which makes it difficult to deliver liquid fuel from the tanks to the aircraft engines at the required flow rates and pressure. The pump must recompress the incoming vapor and also add energy to the incoming fluid to deliver all liquid fuel at the pressure required by the fuel system components downstream of the pump.

Heretofore, various pump designs have been used for handling incoming fuels with a vapor to liquid ratio of up to 0.45, but when the V/L ratio exceeds 0.45, most pumps cannot operate without unacceptable loss in the delivered flow and pressure. Typical of the types of pumps which have been successfully used to pump fuels with up to 0.45 V/L ratio are centrifugal pumps where a portion of the vapor is returned back to the fuel tank; inducer type centrifugal impellers and jet pumps which have relatively good vapor handling capabilities; and positive displacement pumps with large bypass flow under normal operation used to make up for the incoming vapor. As the V/L ratio of the incoming fuels increases, however, these various pumps start to cavitate, resulting in a substantial drop in the delivered flow and/or pressure performance of the pumps below desired operating levels.

Cavitation of the engine driven pumps can be avoided as by pressurizing the fuel tanks or by utilizing a tank mounted boost pump to provide the desired fuel pressure at the inlet to the engine driven pump. However, in this arrangement, the pressure of the fuel in the line from the tank to the engine driven pump is higher than ambient, which is undesirable since if the line from the tank to the engine driven pump is punctured or ruptured in any way, the fuel will leak from the line creating a serious fire hazard.

Such higher pressure in the line from the tank to the engine driven pump can be kept to a minimum by mounting the boost pump closer to the engine driven pump, but that requires that the boost pump be capable of operation with a lower inlet pressure or higher V/L ratio of the fuel entering the boost pump than in the case of the tank mounted condition due to the additional pressure loss created in the line from the tank as a result of frictional losses and change in height from the tank.

SUMMARY OF THE INVENTION

With the foregoing in mind, it is a principal object of this invention to provide a pump capable of handling incoming fuels having a V/L ratio much higher than previous known pumps used for substantially the same purpose.

Another object is to provide such a pump which is capable of handling incoming fuels having a minimum V/L ratio of 1.0.

Still another object is to provide such a pump which is relatively compact and light in weight and has very few moving parts.

Another object is to provide a pump of the type indicated which is relatively inexpensive to manufacture and highly reliable, and is also relatively easy to maintain and repair.

These and other objects of the present invention may be achieved by providing a pump including a unique combination of a centrifugal impeller, inducer and jet pump having the capability of handling incoming fuels with a minimum V/L ratio of 1.0 which far exceeds the existing pump designs with 0.45 V/L capability. The motive flow for the jet nozzle is provided by the high pressure fluid discharge from the centrifugal impeller, and the high velocity jet is used both to create the suction and entrainment of the fuel coming from the suction inlet and to break up the large incoming vapor bubbles. By staging the jet pump with an inducer and centrifugal impeller, the suction and cavitation resistance performance of the jet pump is somewhat reduced, but the inducer performance is much improved because of the breaking up of the large incoming bubbles and homogenizing of the fuel by the high velocity jet before entry of the fuel into the inducer blades, which in turn improves the centrifugal impeller's performance. The axial thrust created by the centrifugal impeller may be reduced by providing holes in the impeller located between the inducer blade exit and centrifugal blade entrance, and also by providing straight radial blades on the back side of the impeller.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 4:
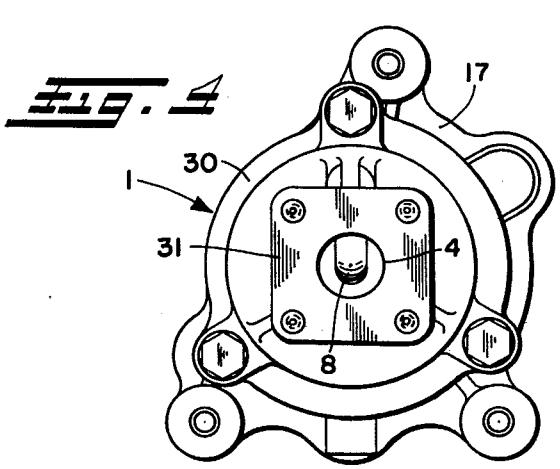
FIG. 4 is an end elevation view of the pump of FIG. 1 as seen from the inlet end looking from the plane of the line 4—4 of FIG. 1.
Figure 1:
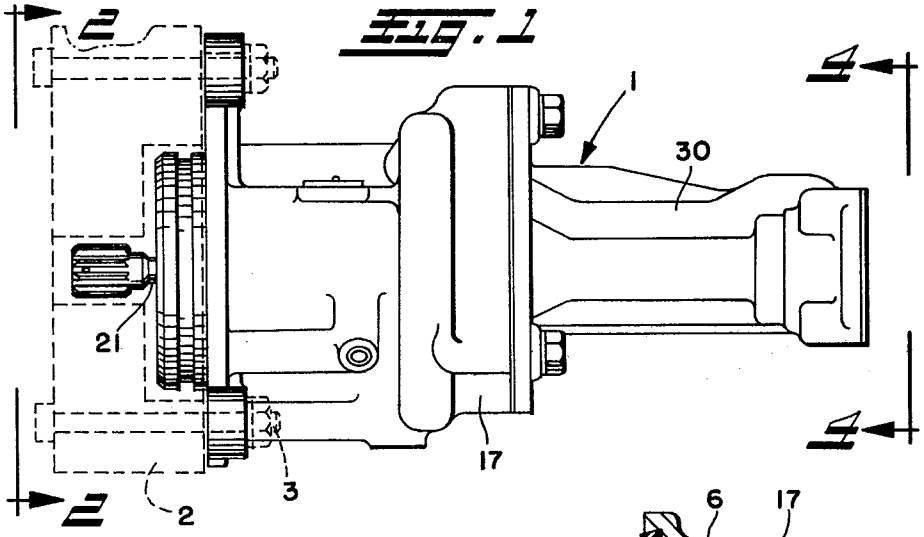
FIG. 1 is a side elevation view of a preferred form of centrifugal pump constructed in accordance with this invention showing in dotted lines a typical mounting for the pump which may be driven by any suitable engine.
Figure 2:
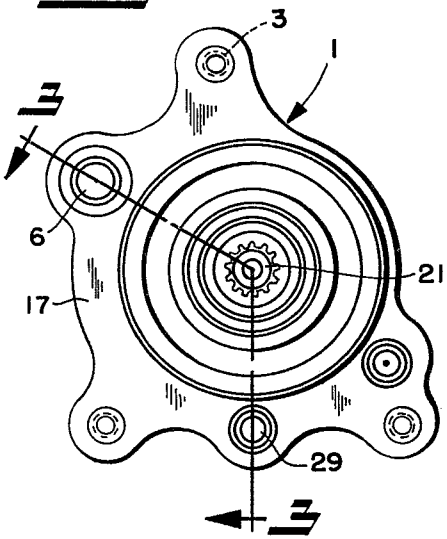
FIG. 2 is an end elevation view of the discharge end of the pump of FIG. 1, as seen from the plane of the line 2—2 thereof.

Referring now in detail to the drawings and initially to FIG. 1 thereof, there is shown a preferred form of pump 1 constructed in accordance with this invention secured to a suitable support structure 2 such as the housing of an aircraft engine as by means of mounting bolts 3 or the like. The pump 1 has a main inlet 4 at one end, best seen in FIGS. 3 and 4 of the drawing, to which a fuel line, not shown, may be connected to provide for flow of fuel from the fuel tanks of the aircraft to the pump, and a main outlet 6 at the other end for connection to the fuel system components downstream of the pump. A protective plug 7 shown in dotted lines in FIG. 3, may be used to cover the pump inlet when not in use as desired.

Figure 3:
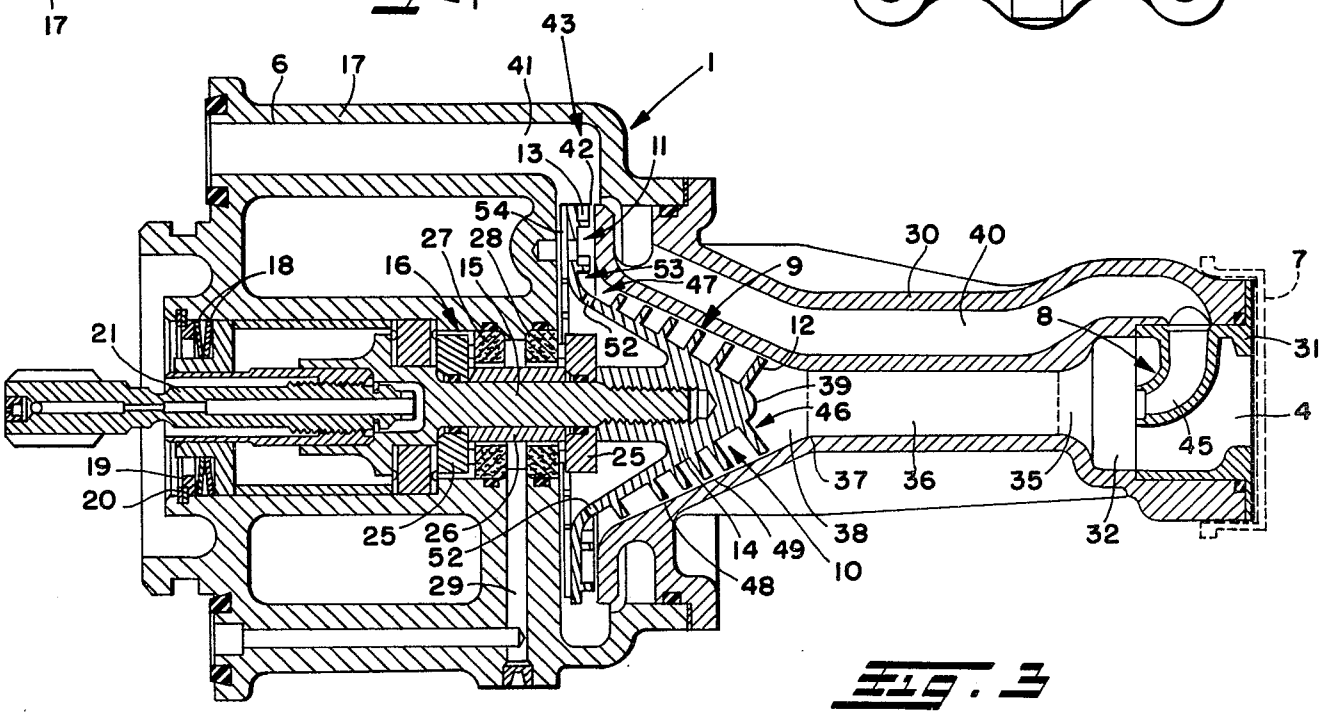
FIG. 3 is an enlarged longitudinal section through the pump of FIG. 2, taken on the plane of the line 3—3 thereof.

As can be seen in FIG. 3, the pump 1 comprises a jet pump 8 in series with a specially designed pump impeller 9 having an inducer section 10 and a centrifugal impeller section 11. The inducer blades 12 and centrifugal impeller blades 13 are desirably provided on a common disc-hub combination 14, which is threaded onto a pump shaft 15 suitably journaled within a central opening 16 in the pump housing 17 and retained in the desired assembled relation by engagement by a pair of spring tension washers 18 secured in place by a retaining ring washer 19 and retaining ring 20 at the other end of the central opening. A suitable drive coupling 21 is shown connected to the drive shaft 15 for coupling the drive shaft to the engine of the aircraft to drive the pump impeller 9 in known manner. Rotating seals 25 separated by a seal spacer 26 may also be provided on the drive shaft 15, with respective fuel and oil seals 27 and 28 intermediate the rotating seals, and a suitable seal drain 29 provided therefor, as desired.

A housing or shroud 30 surrounds the pump impeller 9 and extends outwardly therefrom to the suction inlet 4 which may be formed by a ring 31 pressed into the outer end of the shroud. To simplify the design, the jet nozzle 8 is desirably formed as an integral part of the ring 31.

Adjacent the downstream side of the suction inlet 4 both the shroud 30 and ring 31 are of a greater diameter than the diameter of the suction inlet to provide an entrainment chamber 32 into which the jet nozzle 8 extends. From the entrainment chamber 32, the shroud 30 tapers down to provide a throat section 35 of reduced diameter leading to a mixing tube 36 of substantially uniform diameter over its length. At the exit end 37 of the mixing tube 36, the shroud 30 tapers outwardly to provide a diffuser chamber 38 adjacent the outer tip 39 of the pump impeller 9. The shroud 30 continues its outward taper closely surrounding the inducer blades 12 up to the centrifugal impeller blades 13 and then extends radially outwardly in close proximity to such centrifugal impeller blades.

The motive flow for the jet nozzle 8 is obtained by providing a motive flow passage 40 in the shroud 30 outwardly of the mixing tube 36 having communication at one end with the high pressure discharge chamber 41 which receives high pressure fluid from the centrifugal impeller blades 13 and connected at its other end to the jet nozzle 8. Communication between the high pressure discharge chamber 41 and motive flow passage 40 desirably occurs immediately adjacent the outer diameter of the centrifugal impeller blades 13 and desirably extends at right angles to the normal direction of motion of the fluid at the impeller blades exit 42 as shown in FIG. 3. With this arrangement, any solid particle contaminants in the fuel entering the pump 1 from the tank will have a tendency to centrifuge out in that portion 43 of the high pressure discharge chamber 41 which extends radially outwards beyond the motive flow passage 40 so as to minimize the amount of contaminants recirculated through the nozzle 8, and inducer and centrifugal impeller sections 10 and 11, thus enhancing the pump service life.

The high velocity jet of fluid which is discharged from the jet nozzle 8 into the entrainment chamber 32 not only generates the usual vortex pattern around the jet nozzle to create the necessary suction and entrainment of the fuel coming from the suction inlet 4, but also breaks up the large incoming vapor bubbles in the fuel.

The low fuel pressure caused by fuel tank altitudes and pressure drop through the long pump inlet line produces relatively low pressure at the pump inlet 4. This low pressure at the pump inlet, particularly at relatively high fuel temperatures, results in separation of the air dissolved in the fuel and partial evaporation of the fuel, creating a mixture of vapor and liquid. Also under certain conditions, such as low fuel flow velocities through the inlet line or long inlet lines, the fuel stays in the inlet line for longer periods of time during its course of travel from the fuel tank to the pump inlet. With this longer dwell time, the air and vapor bubbles evolving from the fuel, which are normally small in size at first, have a tendency to combine and create larger bubble sizes.

The amount and size of these vapor bubbles seriously affect the performance of the usual jet pump, inducer pump, or centrifugal pump. However, by staging the jet pump 8 with the inducer and centrifugal impeller sections 10 and 11 of the pump of the present invention, although the jet pump's suction and cavitation resistance performance is somewhat reduced, the high velocity jet is effectively used to break up the large incoming bubbles and homogenize the fuel before entry of the fuel into the inducer blades 12, resulting in improved inducer performance which in turn improves the centrifugal impeller performance. With the inducer and centrifugal impeller sections 10 and 11 operating above a minimum acceptable performance, there is sufficient energy available to provide the motive flow for the jet nozzle 8.

As will be apparent, the combined motive flow fluid from the jet nozzle 8 and fluid drawn in through the suction inlet 4 enter the mixing tube 36 where the fuel is homogenized, after which the fuel travels through the short diffuser section 38 before entering the inducer section 10. In the diffuser section 38, a portion of the fuel velocity head is converted into a pressure head, and the inducer section 10 adds sufficient energy to the fuel to keep the fuel pressure at the centrifugal impeller section inlet 53 high enough to prevent cavitation in the centrifugal impeller section 11 of the pump.

In actual tests, it has been found that if only one of the three pump elements of the present invention, that is, the jet pump 8, inducer section 10 or centrifugal impeller section 11, or any combination of any two of the pump elements is used, the performance of the pump is not nearly as good as when the three pump elements are used in combination in the manner disclosed herein for operation with incoming fuels having a high V/L ratio as aforesaid. It has also been found that for best results the various pump elements should be carefully sized to match each other. For instance, the internal passage 45 of the jet nozzle 8 should have a preferred contour, and the nozzle 8 diameter and its area ratio should be related to the throat 35 area, as should the spacing of the nozzle 8 with respect to the throat section 35.

The entrainment chamber 32 size and shape and radius of the walls at the inlet to the throat section 35 will also have an effect on the performance of the pump, as will the mixing tube 36 area and length, diffuser 38 size and shape, and inducer section 10 overall design, including inducer eye diameter and blade 12 angle at the inducer inlet 46, number of inducer blades 12 and the blade shape from inlet 46 to exit 47. Also, the centrifugal impeller blade 13 layout and blade height and amount of motive flow will have a direct effect on the performance of the pump.

Figure 6:
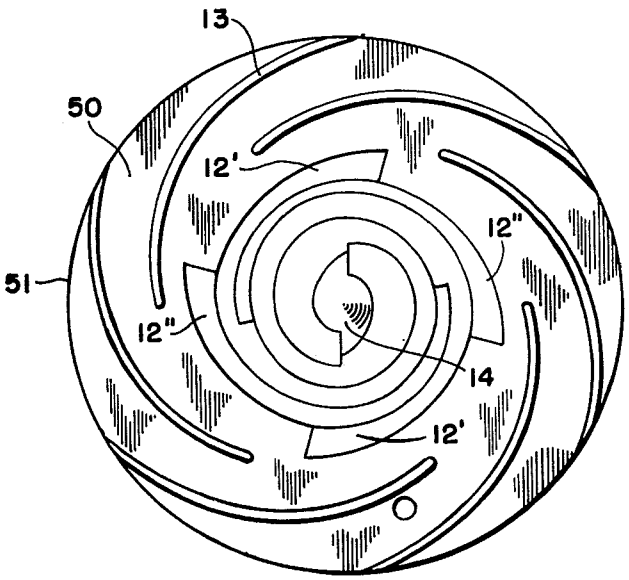
FIG. 6 is an end elevation view of the front side of the impeller and inducer blades on the pump impeller of FIG. 5, as seen from the plane of the line 6—6 thereof.
Figure 5:
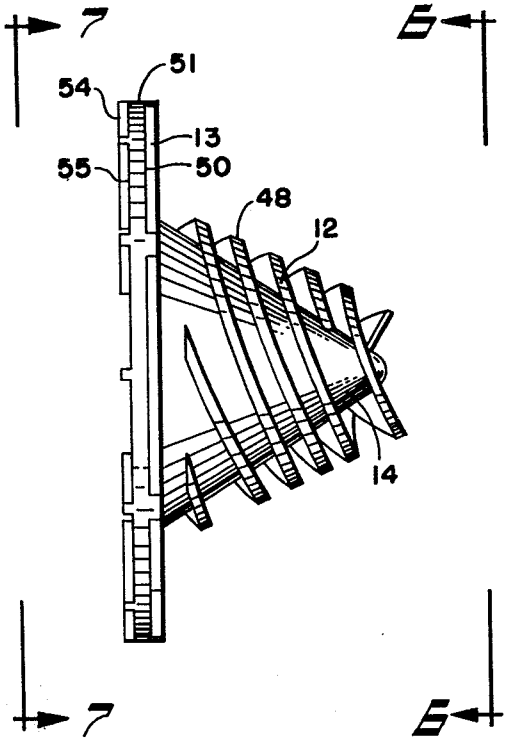
FIG. 5 is an enlarged side elevation view of the pump impeller of the present invention.

In the preferred form of pump 1 shown by way of example, the suction inlet 4 has a diameter of approximately 0.6 inch and the jet nozzle 8 has an inner diameter of approximately 0.14 inch at the outlet. The inner diameter of the mixing tube 36 is approximately 0.43 inch and tapers outwardly at its inner end at an included angle of approximately 50° to define with the impeller hub 14 the diffuser and inducer sections 10 and 11. The impeller hub 14 itself has an included angle of approximately 66°, and there are four inducer blades 12 on the impeller hub which, as best seen in FIGS. 5 and 6, are equally spaced from each other, with two of the blades 12' being full and the other two blades 12" being splitters which start at a 350° point and extend helically around the impeller hub. The outer edges 48 of the inducer blades 12 also desirably extend at an included angle of approximately 50° to correspond to the angle of taper of the outwardly tapered shroud portion 49 surrounding the same and closely spaced therefrom.

The centrifugal impeller blades 13 are located radially outwardly of the inducer blades 12 and as also best seen in FIGS. 5 and 6, extend at an angle along the radial front face 50 of the impeller flange 51 to the outer edge thereof, six such uniformly spaced centrifugal impeller blades 13 of substantially the same convolute shape being shown.

Figure 7:
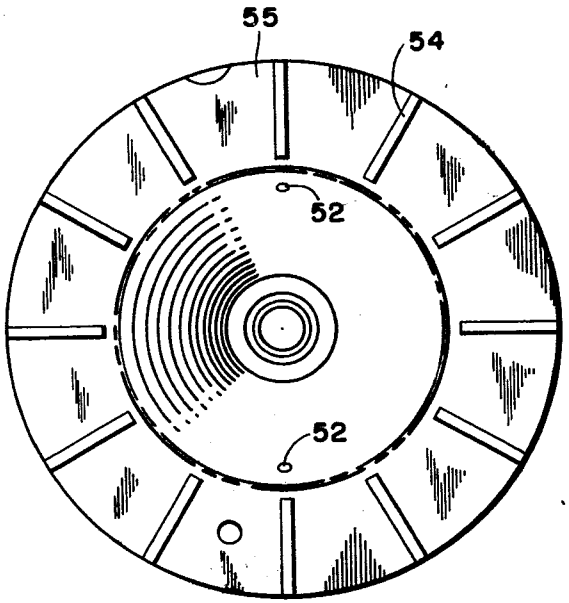
FIG. 7 is an end elevation view of the back side of the pump impeller of FIG. 5 as seen from the plane of the line 7—7 thereof.

To reduce the axial thrust created by the pump impeller 9 during rotation, two holes 52 are desirably provided on the pump impeller in the region between the inducer blade exit 47 and centrifugal blade entrance 53. Also, straight radial blades 54 are desirably provided on the back face 55 of the pump impeller 9 as seen in FIGS. 3, 5 and 7 to reduce axial thrust. The entry of the low pressure fuel through the two impeller holes 52, in addition to reducing the impeller back pressure, also creates a fuel circulation in the region of the back side of the impeller to keep the fuel seal 28 cool.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the claims.

The embodiments of the invention in which an exclusive property or privilege is claimed are defined as follows:

1. A centrifugal pump capable of pumping fluids having a high vapor to liquid ratio comprising a housing containing a main inlet for said pump and a main outlet for the fluid being pumped, a jet pump having a jet nozzle downstream of said main inlet in communication therewith so that all of the incoming fluid from said main inlet flows past said jet nozzle, an inducer and centrifugal impeller downstream of said jet nozzle in series therewith and with said main inlet so that all of the incoming fluid from said main inlet and from said jet nozzle first flows through said inducer and then through said centrifugal impeller, means mounting said inducer and centrifugal impeller for rotation to pressurize the combined fluid received from said main inlet and said jet nozzle and deliver such pressurized fluid to said main outlet, and a motive flow passage in said housing for directing a portion of the pressurized fluid discharge from said centrifugal impeller to said jet pump to provide the motive flow for said jet nozzle, said inducer and centrifugal impeller comprising inducer blades and centrifugal impeller blades provided on a common disc-hub combination mounted for rotation, said disc-hub combination having an outwardly tapered portion on which said inducer blades are helically wound, and a radial disc at the outermost end of said tapered portion having a front face on which said centrifugal impeller blades are provided, said disc-hub combination having holes in the region between said inducer blades and centrifugal impeller blades to permit fluid pressure to act on the back side of said disc-hub combination to reduce axial thrust caused by said blades during rotation.

2. The pump of claim 1 wherein said radial disc has a back face on which a plurality of straight radial blades are provided to further reduce axial thrust.

3. A centrifugal pump capable of pumping fluids having a high vapor to liquid ratio comprising a housing containing a main inlet for said pump and a main outlet for the fluid being pumped, a jet pump having a jet nozzle downstream of said main inlet in communication therewith so that all of the incoming fluid from said main inlet flows past said jet nozzle, an inducer downstream of said jet nozzle in series therewith which receives all of the fluid from said main inlet and said jet nozzle, a centrifugal impeller immediately downstream of said inducer in series therewith which receives all of the fluid from said inducer, means mounting said inducer and centrifugal impeller for rotation, said inducer including means for pressurizing the combined fluid received from said main inlet and said jet nozzle and supplying such pressurized fluid to said centrifugal impeller, said centrifugal impeller including means for delivering such pressurized fluid to said main outlet, and a motive flow passage in said housing for directing a portion of the pressurized fluid discharged from said centrifugal impeller to said jet pump to provide the motive flow for said jet nozzle, said inducer comprising four helical inducer blades on said tapered hub equally spaced from each other, two alternate ones of said inducer blades being full and the other two of said inducer blades being splitters which terminate intermediate the ends of said full inducer blades, said housing also being tapered in the region of said inducer to closely surround said inducer blades.

4. The pump of claim 3 wherein the outer edges of said inducer blades extend at an included angle corresponding to the angle of taper of said housing surrounding said inducer blades and closely spaced therefrom, and the included angle of said tapered hub is greater than the included angle of said inducer blades.

5. A centrifugal pump capable of pumping fluids having a high vapor to liquid ratio comprising a housing containing a main inlet for said pump and a main outlet for the fluid being pumped, a jet pump having a jet nozzle downstream of said main inlet in communication therewith so that all of the incoming fluid from said main inlet flows past said jet nozzle, an inducer downstream of said jet nozzle in series therewith which receives all of the fluid from said main inlet and said jet nozzle, a centrifugal impeller immediately downstream of said inducer in series therewith which receives all of the fluid from said inducer, means mounting said inducer and centrifugal impeller for rotation, said inducer including means for pressurizing the combined fluid received from said main inlet and said jet nozzle and supplying such pressurized fluid to said centrifugal impeller, said centrifugal impeller including means for delivering such pressurized fluid to said main outlet, and a motive flow passage in said housing for directing a portion of the pressurized fluid discharged from said centrifugal impeller to said jet pump to provide the motive flow for said jet nozzle, said housing including a shroud surrounding said inducer and centrifugal impeller and extending therefrom to said main inlet, said main inlet comprising a ring pressed into the outer end of said shroud.

6. The pump of claim 5 wherein said jet nozzle is formed as an integral part of said ring.

7. The pump of claim 5 wherein there is an entrainment chamber in said housing immediately downstream of said main inlet surrounding said jet nozzle, said entrainment chamber being of a larger diameter than said main inlet.

8. The pump of claim 7 wherein there is a mixing tube through which the fluid immediately passes from said entrainment chamber to said inducer, and a tapered throat section leading from said entrainment chamber to said mixing tube.

9. The pump of claim 8 wherein there is a diffuser chamber intermediate said inducer and mixing tube, said diffuser chamber having outwardly tapered walls.

10. A centrifugal pump capable of pumping fluids having a high vapor to liquid ratio comprising a housing containing a main inlet for said pump and a main outlet for the fluid being pumped, a jet pump having a jet nozzle downstream of said main inlet in communication therewith so that all of the incoming fluid from said main inlet flows past said jet nozzle, an inducer downstream of said jet nozzle in series therewith which receives all of the fluid from said main inlet and said jet nozzle, a centrifugal impeller immediately downstream of said inducer in series therewith which receives all of the fluid from said inducer, means mounting said inducer and centrifugal impeller for rotation, said inducer including means for pressurizing the combined fluid received from said main inlet and said jet nozzle and supplying such pressurized fluid to said centrifugal impeller, said centrifugal impeller including means for delivering such pressurized fluid to said main outlet, and a motive flow passage in said housing for directing a portion of the pressurized fluid discharged from said centrifugal impeller to said jet pump to provide the motive flow for said jet nozzle, said motive flow passage communicating with the pressurized fluid immediately adjacent the outer diameter of said centrifugal impeller and extending at right angles to the normal direction of flow of fluid exiting from said centrifugal impeller, and a separate passage for flow of such pressurized fluid to said main outlet which extends from the outer diameter of said centrifugal impeller radially outward of said motive flow passage where said motive flow passage communicates with the pressurized fluid, whereby any solid particle contaminants in the fluid entering the pump will have a tendency to centrifuge out so as to minimize the amount of contaminants recirculated through the pump via the motive flow passage.

11. The pump of claim 10 wherein said inducer comprises a plurality of helical inducer blades on a tapered hub, said housing also being tapered in the region of said inducer to closely surround said inducer blades.

12. The pump of claim 11 wherein said centrifugal impeller comprises a rotatably mounted disc having a front face extending radially outwardly of said tapered hub, and a plurality of impeller blades on said front face extending radially outwardly of said hub, said housing extending radially outwardly in the region of said impeller blades closely adjacent thereto.

13. The pump of claim 12 wherein there are six of said impeller blades of substantially the same convolute shape uniformly spaced around said disc.

14. The pump of claim 10 wherein said housing includes a shroud surrounding said inducer and centrifugal impeller and extending therefrom to said main inlet.

* * * * *